US006422284B1

(12) United States Patent
Kelders et al.

(10) Patent No.: US 6,422,284 B1
(45) Date of Patent: Jul. 23, 2002

(54) MATERIAL TRANSFER DEVICE

(75) Inventors: Johannus Hubertus Jozef Maria Kelders, Drunen; Roy Edwin Van Swieten, Heusden, both of (NL)

(73) Assignee: Henkel KGaA, Dusseldorf (DE)

( * ) Notice: Subject to any disclaimer, the term of this patent is extended or adjusted under 35 U.S.C. 154(b) by 0 days.

(21) Appl. No.: 09/530,440

(22) PCT Filed: Oct. 29, 1998

(86) PCT No.: PCT/EP98/07000

§ 371 (c)(1),
(2), (4) Date: Aug. 1, 2000

(87) PCT Pub. No.: WO99/23022

PCT Pub. Date: May 14, 1999

(30) Foreign Application Priority Data

Oct. 31, 1997 (NL) ..... 1007414
May 1, 1998 (NL) ..... 1009050

(51) Int. Cl.[7] ..... B32B 31/00

(52) U.S. Cl. ..... 156/540; 156/577; 156/579; 118/256; 118/257; 242/160.4; 242/171; 242/588.6

(58) Field of Search ..... 156/540, 577, 156/579; 118/256, 257; 400/695, 696; 242/160.4, 171, 588.6

(56) References Cited

U.S. PATENT DOCUMENTS 5,076,883 A * 12/1991 Bosley ..... 156/522
5,679,156 A * 10/1997 Matsumaru ..... 118/200

FOREIGN PATENT DOCUMENTS

| | | |
|---|---|---|
| DE | 29511439 | 2/1995 |
| DE | 19611440 | 2/1996 |
| EP | 0075485 | 3/1983 |

* cited by examiner

*Primary Examiner*—Richard Crispino
*Assistant Examiner*—Cheryl N. Hawkins
(74) *Attorney, Agent, or Firm*—Webb Ziesenheim Logsdon Orkin & Hanson, P.C.

(57) ABSTRACT

The invention relates to a device for transferring to a surface correcting material supplied on a tape-like carrier, provided with a housing comprising a rotatable supply reel for the carrier with the correcting material, a rotatable take-up reel for the carrier after transfer of the material, a transfer member for placing on the surface and along which the carrier with the material is guided, and displaceable means for covering the transfer member. Inadvertent transfer of material when the device is not in use is hereby prevented. The covering means is operable by an operating member which protrudes out of a wall of the housing. The covering means can comprise a displaceable slide, which can take an at least partially flexible form.

19 Claims, 6 Drawing Sheets

MATERIAL TRANSFER DEVICE

BACKGROUND OF THE INVENTION

1. Field of the Invention

This invention relates to a device for transferring a layer of a material, such as a correction material, from a tape-like carrier to a surface.

2. Description of the Prior Art

Known devices for transferring to a surface a layer of material, for instance correcting material, supplied on a tape-like carrier, include a housing with a rotatable supply reel for the carrier with the material for transferring, a rotatable take-up reel for the carrier after transfer of the material, a transfer member protruding from the housing through a first opening for placing on the surface and along which the carrier with the material is guided, and means for covering the transfer member, said covering means being displaceable between a first position leaving the transfer member free and a second position covering the transfer member. Such a device, which is referred to as a correction roller, is known from DE-A-196 11 440.

With such a correction roller a strip of self-adhesive correcting material can be applied to a surface, for instance to conceal relatively large writing errors. It is then possible to write normally on the correcting material. In the known correction roller the material is arranged on a tape-like carrier which is wound onto a supply reel and guided along the transfer member or the "foot" to a take-up reel. The take-up reel and supply reel are both accommodated rotatably in a housing or frame to which the foot is also fixed, and are connected by means of a coupling so that a rotation of the one reel results in a corresponding rotation of the other reel. In order to compensate differences in the rotation speed resulting from differences in the thickness of the reels, the coupling is usually embodied as a slip coupling. For use the correction roller is simply pressed with its foot onto the surface and subsequently moved therealong, whereby the tape-like carrier with correcting material is unwound from the supply reel as a consequence of the friction. The supply reel rotates, whereby the take-up reel is also rotated and the carrier is wound thereon. Because there is less adhesion between the correcting material and the carrier than between the correcting material and the surface, the correcting material remains behind on the surface.

In conventional correction rollers the foot always protrudes outside the housing. This has the consequence that when the correction roller is not in use there is the danger of the correcting material unintentionally adhering to for instance the clothing of the user. In order to obviate this danger it had already been proposed to arrange a releasable cap over the foot which can be removed prior to use. Such a cap was found in practice not to function properly because it often got lost.

The above-identified prior art document DE-A-196 11 440 already discloses a correction roller having a covering member that is slideably arranged in the housing of the roller. Making use of a covering member connected to the housing prevents this being lost, so that a good protection of the foot is ensured in all circumstances when the correction roller is not in use. This prior art covering member, which surrounds the foot, is cylindrical and in its rest position partially protrudes from the housing through the same opening as the foot. For displacing the covering member from its position of rest to its operative position, the user must grip and pull the end part of the covering member. This implies an awkward movement, which cannot be performed single-handedly.

SUMMARY OF THE INVENTION

The invention therefore has for its object to provide a device of the above described type which is improved from an ergonomical point of view, and which is thus easier to handle. This is achieved according to the invention in such a device by an operating member connected to the covering means and protruding from a second opening arranged in a wall of the housing. Since the operating member is thus accessible through a wall of the housing, the covering means are easy to operate with the same hand that holds the roller, which allows an ergonomically favorable roller design to be obtained.

In a structurally relatively simple embodiment of the invention which is very practical in use, the covering means comprise a slide.

Advantageously, the operating member herein protrudes out of the housing through a slot extending in the displacement direction of the slide, whereby an additional guiding for the slide is created and the stroke of the slide can be bounded by the ends of the slot.

When the operating member is fixed from the outside of the housing to the covering means, the is dimensions thereof do not have to be limited to the width of the slot, thereby enabling an ergonomically optimal operating member.

In its covering position the covering slide preferably defines a support surface together with a part of the housing. The device can thus be put aside easily when not in use.

When the covering slide is at least partially flexible, it can be guided in simple manner along the inner side of the wall of the housing, thereby achieving a large measure of freedom in the design and placing of the slide. The slide can herein be embodied such that in its covering position it at least partially encloses the transfer member, thus achieving optimum protection of the transfer member.

BRIEF DESCRIPTION OF THE DRAWINGS

The invention is elucidated hereinbelow on the basis of a number of embodiments, wherein reference is made to the annexed drawing, in which.

DETAILED DESCRIPTION OF THE PREFERRED EMBODIMENTS

Figure 1:
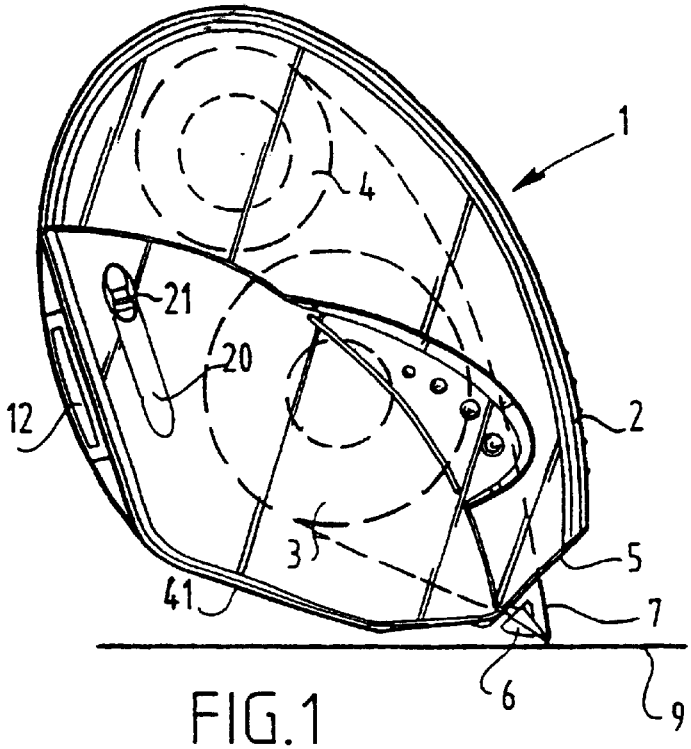
FIG. 1 is a schematic side view of a first embodiment of a correction roller according to the invention in its position of use.
Figure 2:
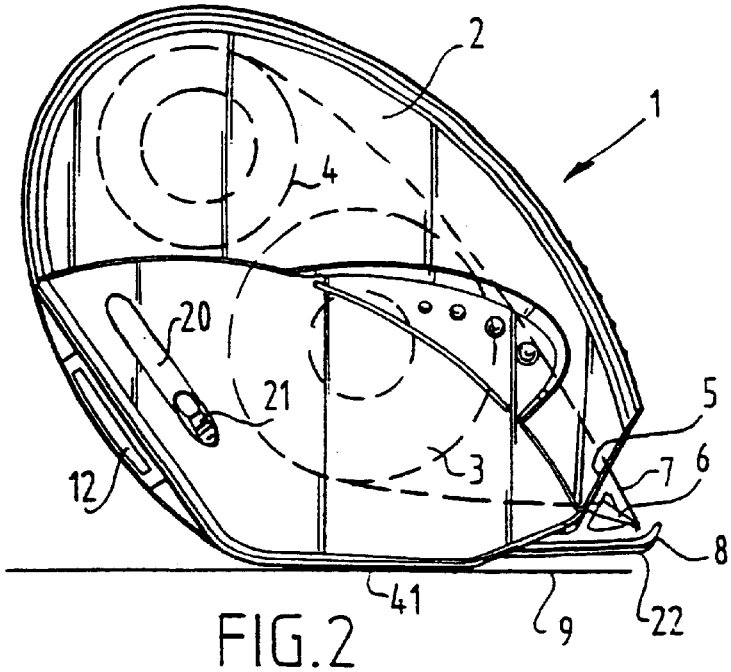
FIG. 2 shows a view corresponding with FIG. 1 of this correction roller in its rest position with extended covering slide.

A correction roller 1 comprises a housing 2 having therein a supply reel 3 and a take-up reel 4. The housing has an opening 5 and a foot 6 arranged in the proximity thereof. The correcting material is arranged on a tape-like carrier 7 which is guided from supply reel 3 along foot 6 to the take-up reel. Further received in housing 2 is a covering slide 8 which is slidable between a rest position (FIG. 1) in which foot 6 is left clear and the correcting material can be transferred onto surface 9, and a covering position (FIG. 2) in which the correcting material is protected at the position of foot 6.

Figure 3:
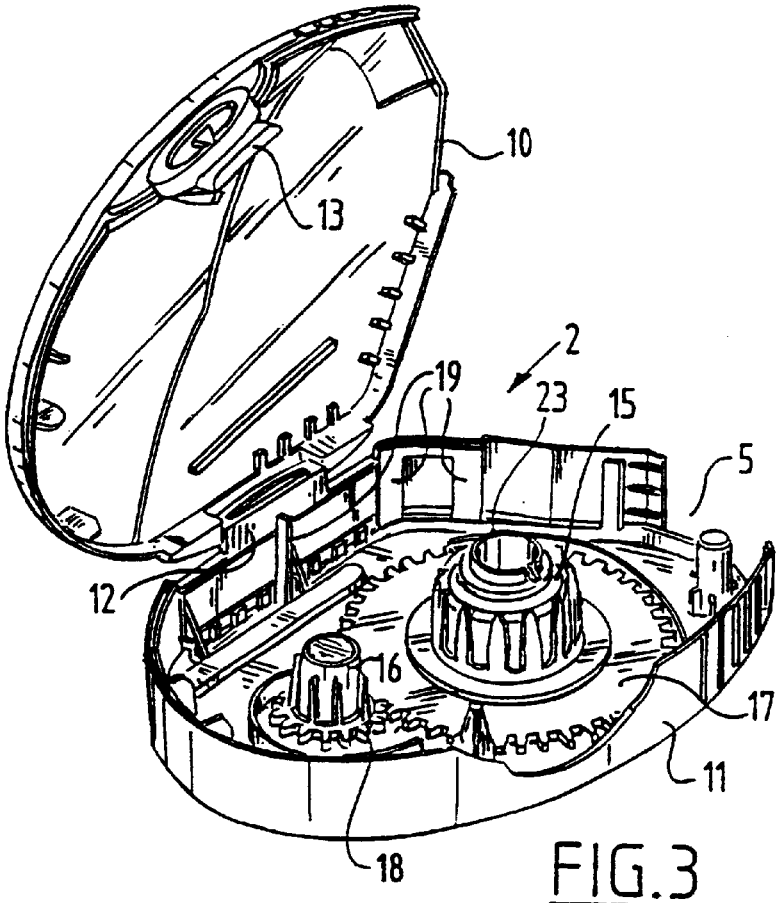
FIGS. 3 and 4 show perspective views from different directions of the housing of the roller with the covering slide accommodated therein.
Figure 4:
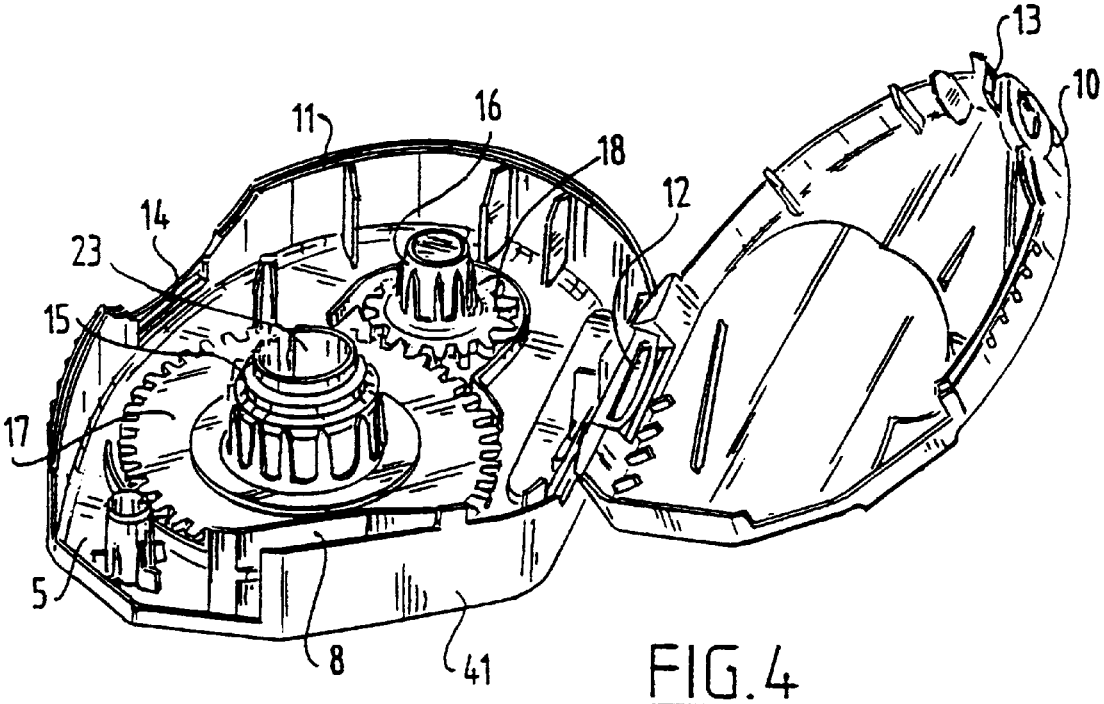

In the shown embodiment, supply reel 3, take-up reel 4 and foot 6 are accommodated in an exchangeable cassette which can be placed releasably in housing 2. Housing 2 is embodied for this purpose in two parts, wherein parts 10, 11 are mutually connected by means of a hinge 12 (FIG. 3, 4) and can be closed by means of a snap member 13 and a snap edge 14 co-acting therewith. Further arranged in housing 2 are rotatable shafts 15, 16 onto which reels 3, 4 of the cassette can be placed. These rotatable shafts, which are snapped or clamped onto stationary stubs 23, 24, are mutually connected by means of gears 17, 18. A slip coupling (not shown) is further arranged in known manner between reels 3, 4 to compensate for differences in rotation speed as supply reel 3 empties and take-up reel 4 fills up.

Covering slide 8 is guided in housing 2 by means of a number of guides 19 and is accessible from the outside of housing 2 through a slot 20. For operation thereof the covering slide 8 is provided with an operating member in the form of a protruding button 21 which is formed integrally with slide 8 and placed through slot 20 from the inside of housing 2. In the shown embodiment the slide 8 is further embodied such that together with a bottom wall 41 of housing 2 it defines a support surface 22 on which correction roller 1 can stand when it is not in use.

Figure 6:
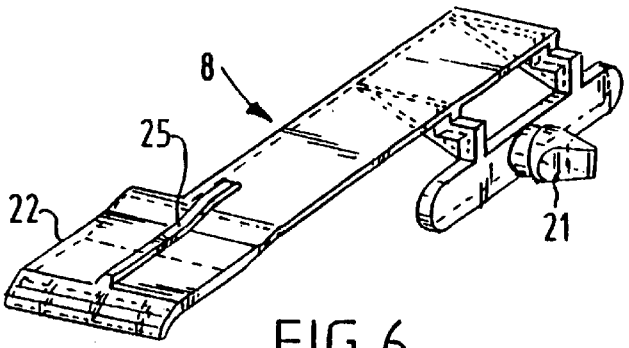
FIGS. 5, 6 and 7 show perspective views of the covering slide from different directions.
Figure 5:
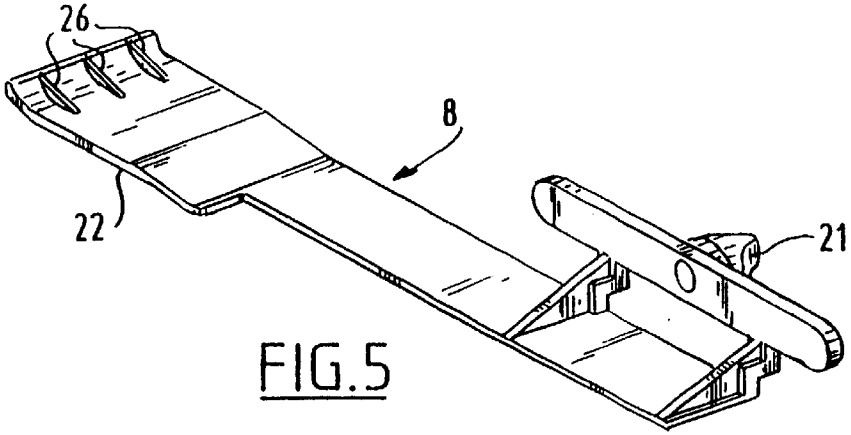
Figure 7:
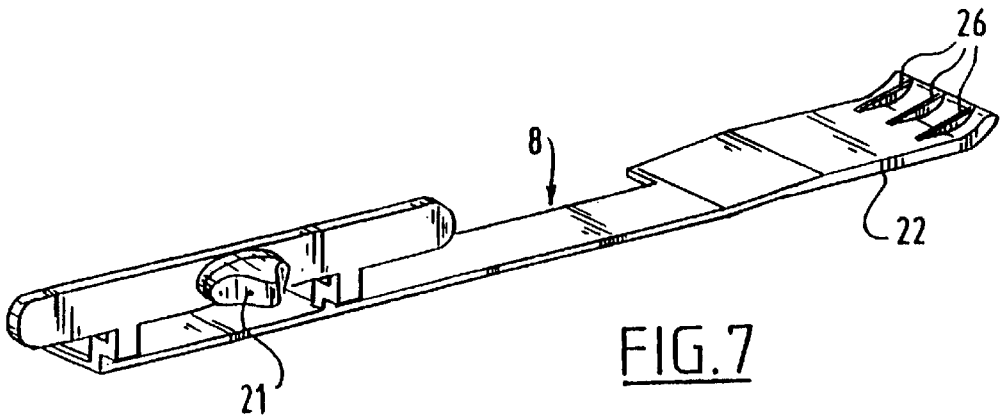

Covering slide 8 here takes a flexible form along a part of its length so that it can be guided along the bent bottom wall of housing 2. The operating member can hereby be accommodated in a part or the housing where there is still a relatively large amount of space, in the proximity of reel 4. Slide 8 is herein provided on its underside with a relatively low central strengthening rib 25 (FIG. 6) which extends over the part of the slide which can be extended, and has on the upper side three small ribs 26 close to the free end (FIGS. 5, 7).

Figure 8:
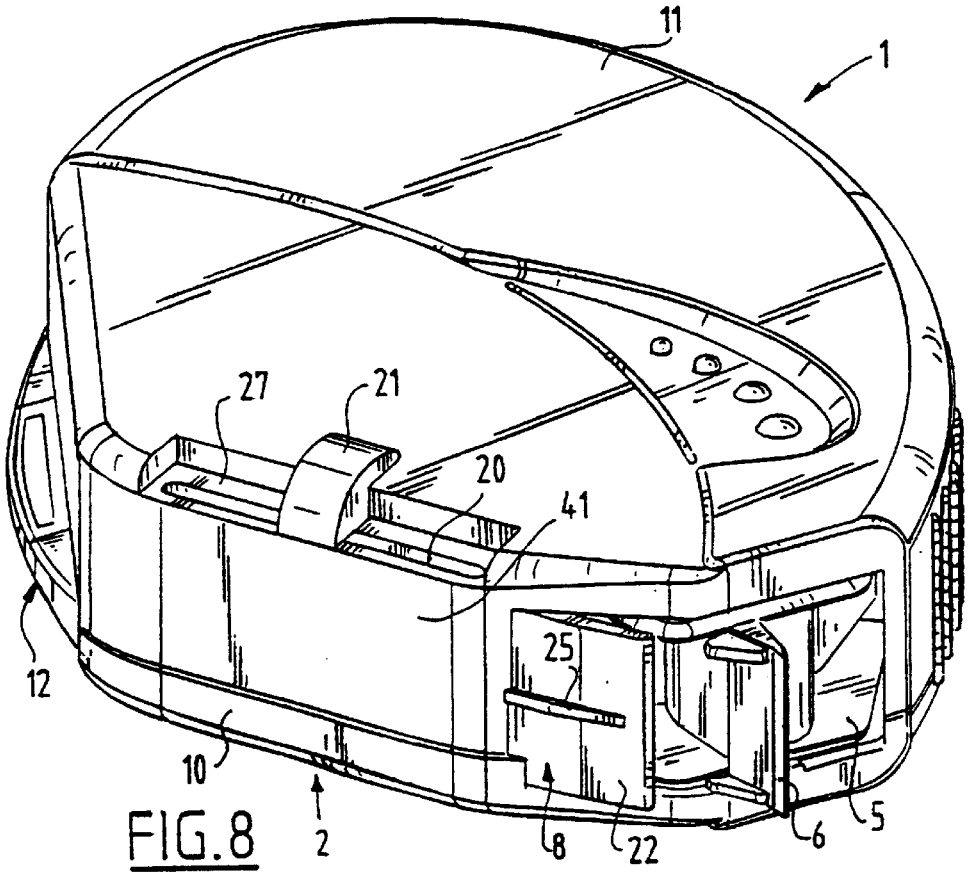
FIG. 8 is a perspective view of a second embodiment of the correction roller according to the invention with partly extended covering slide.
Figure 9:
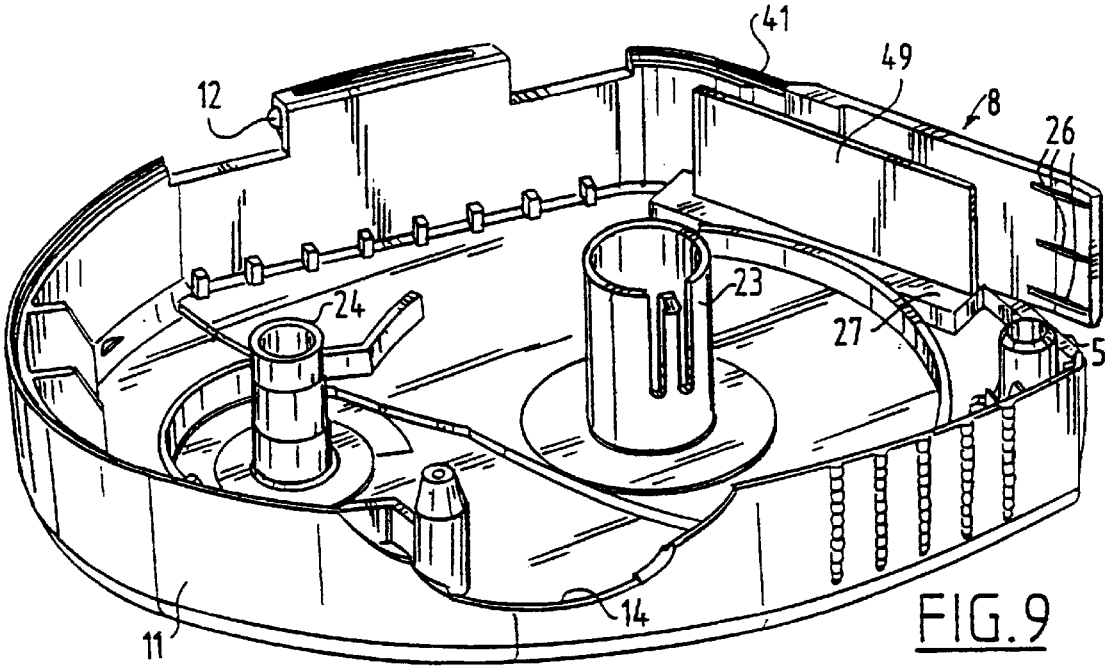
FIG. 9 is a perspective view of a half of the housing of this second correction roller.

In another embodiment of correction roller 1, the covering slide 8 is arranged solely along the bottom wall 41 of the housing (FIGS. 8, 9) and is thus considerably shorter than the slide of the foregoing embodiment. Slide 8 can also be given a sturdier form since it does not have to be flexible. Because there is relatively little space at the position in housing 2 chosen in this embodiment, slot 20 practically coincides here with the edge between the side wall and bottom wall 41 of housing 2. A recess 27 is herein arranged in the side wall at the position of the slot.

Figure 10:
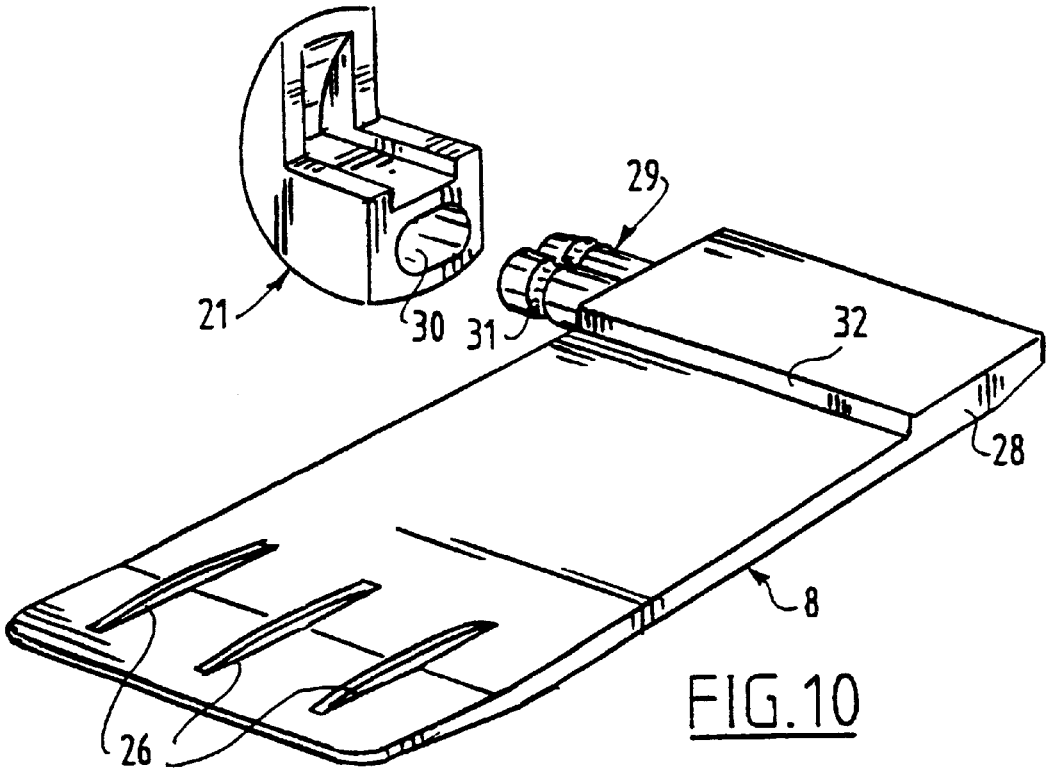
FIG. 10 is a perspective view of the two parts of the covering slide of the roller of FIGS. 8 and 9, FIGS. 11A, 11B and 11C show in schematic longitudinal section a third embodiment of the correction roller according to the invention.

Covering slide 8 is provided in this embodiment with a separate operating member 21 which is fixed from the outside onto the slide after this latter has been mounted in housing 2. Slide 8 is provided for this purpose with a protruding fixing member 29 (FIG. 10), here in the form of a double pin of ∞-shaped cross section which can be snapped into an aperture 30 of operating member 21. The fixing member has for this purpose a peripheral groove 31 which co-acts with a correspondingly embodied peripheral edge in aperture 30. Slide 8 otherwise takes a thickened form at the position of pins 29 and has a step-like edge 32 which can function simultaneously as stop to bound the displacement of slide 8.

Because operating member 21 is arranged from the outside, it does not have to fit through slot 20, so that the shape and dimensions thereof can be freely chosen. An operating member which is easy to handle and robust can hereby be formed. Operating member 21 is formed in this embodiment in the shape of a circle segment with a part which engages in recess 27 and a part which protrudes outside the side wall of housing 2 and which is guided therealong.

Figure 12:
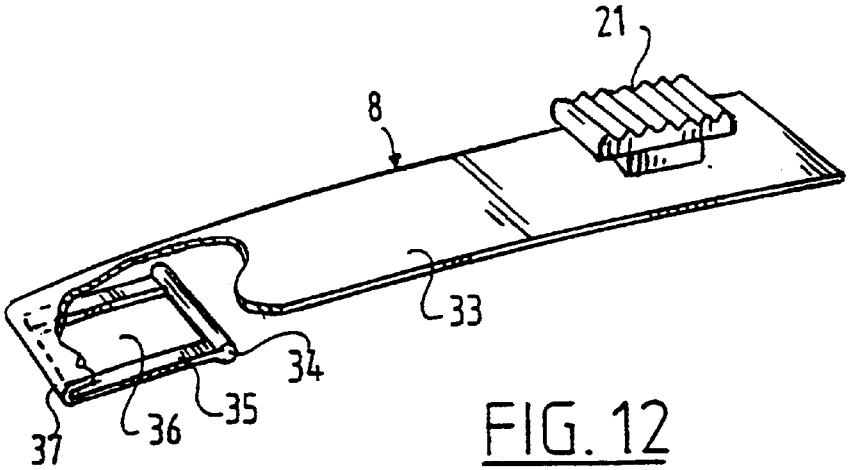
FIG. 12 shows a partly broken-away perspective view of the covering slide of the roller of FIG. 11.
Figure 11A:
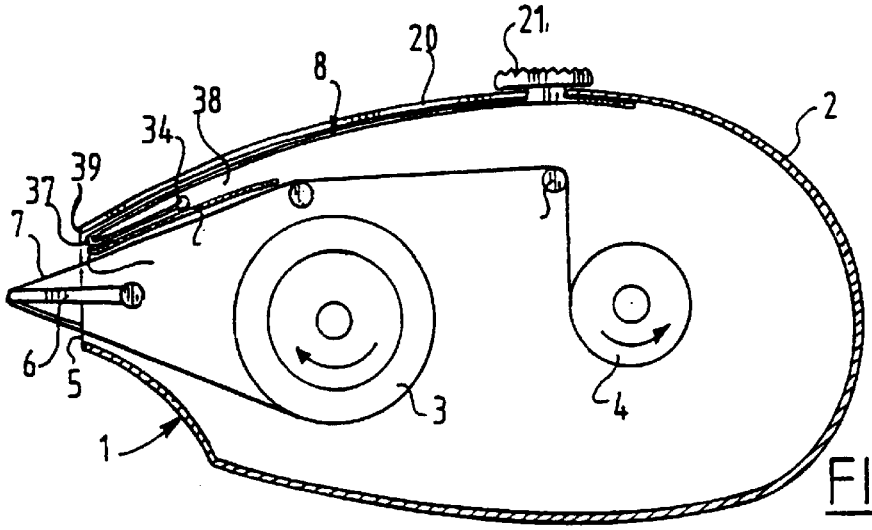

In a third embodiment of the correction roller according to the invention (FIG. 11), covering slide 8 is arranged on the top side of housing 2. Slide 8 herein consists of a strip 33 of a resiliently flexible material on which an operating member 21 is once again arranged (FIG. 12). The leading edge 37 of strip 33 is connected to tensioning members 35, for instance folded-over parts of the strip. A space 36 is left clear between tensioning members 35 for receiving transfer member 6. Slide 8 is arranged in the folded state in the space 38 between guide 19 and the top wall of housing 2. Arranged on the end of tensioning members 35 is a stop, here in the form of a thickened portion 34, the dimensions of which are such that it does not pass through between the end edge 39 of the top wall of the housing and the end edge 40 of guide 19.

Figure 11B:
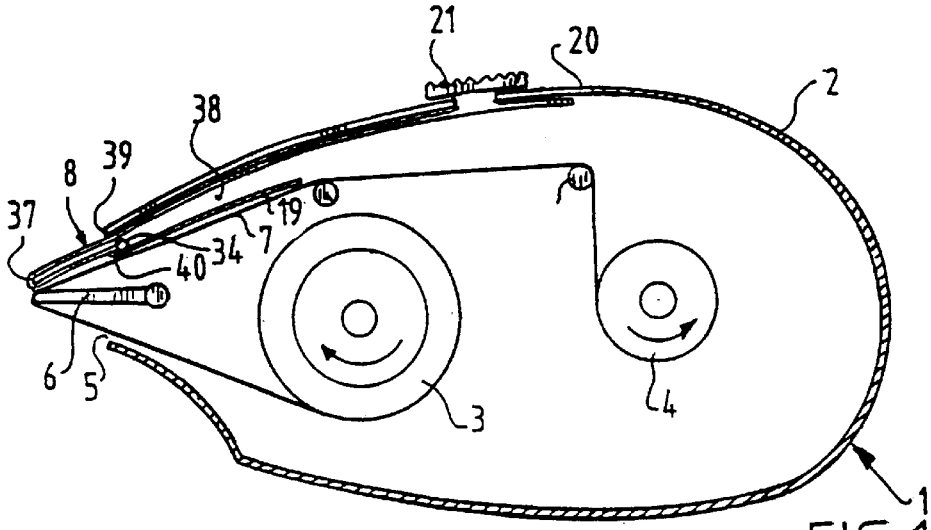
Figure 11C:
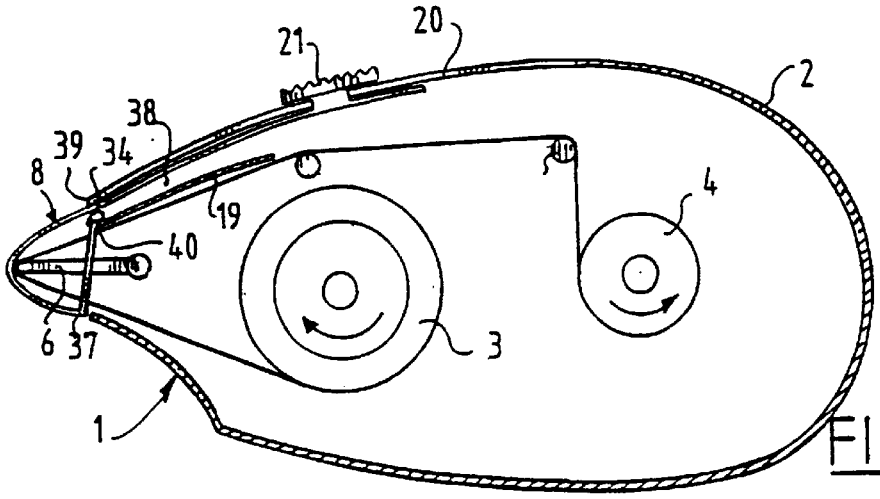

When operating member 21 is now pushed forward from the non-covering position (FIG. 11A), slide 8 is first carried outward in folded state (FIG. 11B). However, as soon as thickened portion 34 reaches the end edges 39, 40 of the housing and the guide, it will be stopped, whereby tensioning members 35 cannot be pushed further outward. With a continued movement of operating member 21 the tensioning members 35, and therewith the leading edge 37 of slide 8, will therefore perform a pivoting movement round the edge 40 of guide 19, wherein strip 33 will assume a bulging position and will almost completely enclose transfer member 6 which will herein protrude into space 36.

In contrast to the foregoing embodiments, supply reel 3 and take-up reel 4 are otherwise arranged in this embodiment not in a cassette but in housing 2 itself.

Although the invention is elucidated above with reference to a correction roller, it is not of course limited thereto. Instead of a correcting material other materials, like e.g. a fluorescent marking material or a glue could also be applied to the tape-like carrier. Furthermore, the operating member need not necessarily be arranged for a sliding movement, but could also be embodied as a rotary knob driving a gear, which would then mesh with a rack connected to the slide. The other shown and described features of the invention can also be varied in many ways without falling outside the scope of the invention. The scope of the invention is therefore defined solely by the appended claims.

What is claimed is:

1. A device for transferring to a surface a layer of material supplied on a tape carrier, comprising:

a) a housing, b) a rotatable supply reel for the carrier with the material for transferring, wherein the supply reel is within the housing and defines a supply side of the tape carrier, c) a rotatable take-up reel for the carrier after transfer of the material, wherein the take-up reel is within the housing and defines a take-up side of the tape carrier, d) a transfer member protruding from the housing through a first opening for placing material on the surface at a transfer point and along which the carrier with the material is guided, wherein the transfer member has a bottom upon which rests the supply side of the tape carrier and a top upon which the take-up side of the tape carrier rests with transfer member sides therebetween, e) means for covering the transfer member, said means for covering comprised of a covering slide being displaceable by translation between a first position leaving the transfer member unprotected and a second position wherein the slide protrudes from the housing to cover the bottom of the transfer member while leaving the transfer member sides exposed, and f) an operating member connected to the covering slide and protruding from a second opening arranged in a wall of the housing.

2. The material transfer device as claimed in claim 1, wherein the operating member protrudes out of the housing through a slot extending in the displacement direction of the covering slide.

3. The material transfer device as claimed in claim 1, wherein the operating member is fixed from the outside of the housing to the covering slide.

4. The material transfer device as claimed in claim 1, wherein in its second position the covering slide defines a support surface of the housing.

5. The material transfer device as claimed in claim 1, wherein the covering slide is at least partially flexible.

6. The material transfer device as claimed in claim 5, wherein in its second position the covering slide at least partially encloses the transfer member.

7. The material transfer device as claimed in claim 1, wherein the operating member protrudes out of the housing through a slot extending in the displacement direction of the covering slide.

8. The material transfer device as claimed in claim 1, wherein the operating member is fixed from the outside of the housing to the covering slide.

9. The material transfer device as claimed in claim 2, wherein the operating member is fixed from the outside of the housing to the covering slide.

10. The material transfer device as claimed in claim 2, wherein in its second position the covering slide defines a support surface of the housing.

11. The material transfer device as claimed in claim 3, wherein in its second position the covering slide defines a support surface of the housing.

12. The material transfer device as claimed in claim 2, wherein the covering slide is at least partially flexible.

13. The material transfer device as claimed in claim 3, wherein the covering slide is at least partially flexible.

14. The material transfer device as claimed in claim 4, wherein the covering slide is at least partially flexible.

15. The material transfer device as claimed in claim 12, wherein in its second position the covering slide at least partially encloses the transfer member.

16. The material transfer device as claimed in claim 13, wherein in its second position the covering slide at least partially encloses the transfer member.

17. The material transfer device as claimed in claim 14, wherein in its second position the covering slide at least partially encloses the transfer member.

18. The material transfer device according to claim 1 wherein the material is correction tape.

19. The material transfer device according to claim 1 wherein in the second position the covering slide also covers the top of the transfer member.

* * * * *